US006575799B1

(12) United States Patent
Stimpson et al.

(10) Patent No.: US 6,575,799 B1
(45) Date of Patent: Jun. 10, 2003

(54) RESCUE DEVICE

(75) Inventors: Richard Stimpson, Tyngsboro, MA (US); Steve Kraytenberg, Londonderry, NH (US); Ralph Marrone, Westford, MA (US); Laura Marrone, Westford, MA (US)

(73) Assignee: A.Q.L. LLC, Westford, MA (US)

( * ) Notice: Subject to any disclaimer, the term of this patent is extended or adjusted under 35 U.S.C. 154(b) by 0 days.

(21) Appl. No.: 10/131,557

(22) Filed: Apr. 23, 2002

Related U.S. Application Data

(63) Continuation-in-part of application No. 09/804,135, filed on Mar. 12, 2000, now abandoned.
(60) Provisional application No. 60/188,647, filed on Mar. 10, 2000.

(51) Int. Cl.[7] ..... B63C 9/00
(52) U.S. Cl. ..... 441/80; 441/80; 441/84
(58) Field of Search ..... 441/80, 84, 85; 114/219, 230.1, 230.26, 230.29

(56) References Cited

U.S. PATENT DOCUMENTS 816,681 A 4/1906 Piller
1,140,358 A 5/1915 Cleave
2,088,251 A 7/1937 Walters
2,192,203 A 3/1940 Purdy
2,342,868 A 2/1944 King
3,981,526 A 9/1976 Lundqvist
4,047,257 A 9/1977 Bondarchuk, Sr.
RE29,728 E 8/1978 Franklin
4,661,077 A 4/1987 Griffith et al.
4,701,145 A 10/1987 Foresman
4,713,033 A 12/1987 Cameron
4,976,642 A 12/1990 Wilkie
5,433,637 A 7/1995 Graves
5,895,299 A 4/1999 Hyde
5,980,158 A 11/1999 Griffiths et al.
6,019,651 A 2/2000 Driscoll et al.
6,050,869 A 4/2000 Kellet

*Primary Examiner*—Ed Swinehart
(74) *Attorney, Agent, or Firm*—Maine & Asmus

(57) ABSTRACT

The invention in the simplest form is an emergency rescue device the stores conveniently and provides a rapid deployment. The invention comprises a length of rope interconnected to a weighted throwing unit having a loop portion with an automatic restraining system. The throwing unit is used to position the loop in close proximity to the distressed person, wherein the person only need to insert his/her hands within the loop. The rescue personnel pulls the rope which tightens the loop and firmly holds the wrists of the person in a hyper extended position.

16 Claims, 8 Drawing Sheets

RESCUE DEVICE

CROSS REFERENCE TO RELATED APPLICATIONS

This application claims priority under 35 U.S.C Section 119 from U.S. Provisional Patent Application No. 60/188,647 filed on Mar. 10, 2000, and under 35 U.S.C. Section 120 as a Continuation-in-Part of U.S. patent application Ser. No. 09/804,135, filed Mar. 12, 2001, now abandoned, which are incorporated herein by reference for all purposes.

BACKGROUND OF THE INVENTION

1. Technical Field of the Invention

The present invention relates to a rescue device and emergency apparatus. More specifically, the present invention comprises a weighted throwing portion secured to a length of rope, and an adjustable wrist loop secured a short distance from the throwing portion.

2. Background Art

Each year numerous lives are lost because aid was not quickly available, even when bystanders and emergency crews are present. Most rescue operations require a certain amount of time to prepare and execute—and time that can be fatal to a person in distress.

There are also hazards to the rescue personnel or bystander, especially if attempting the rescue without proper planning. Many tragic stories tell of the Good Samaritan that attempted to rescue a victim in distress only to become a victim of the same fate.

Persons in distress in water pose several problems to a rescuer. The distressed person will likely cling to whatever is within reach, including a prospective rescuer. A drowning person lacks the capacity of reasoning and can present a serious threat to an unqualified or unsuspecting rescuer. For this reason, lifeguards normally keep a safe distance between themselves and the victim. The lifeguard typically uses a buoy or other floatation device to present to the victim to grasp and can then safely haul the buoy and victim to shore. If there is no separation device, a lifeguard dives below the surface and positions the victim into a safe and controlled orientation before attempting to swim to shore. In the event that the victim does manage to grab hold of a lifeguard, the preferred escape is to dive under the water and break-away from the victim.

Rescue operations in ice present even greater danger to the victim and rescue persons. Hypothermia is a major concern, and a person that falls into frigid water only has a few minutes before the effects of hypothermia develop. Hypothermia causes the body to enter into a state of shock that inhibits coordination and muscular control. It also effects the mental state and a person may become unconscious. A further problem relates to the ice itself, the area surrounding a break is usually more susceptible to breaking, thus a rescue person that exerts too much pressure upon the ice may wind up stuck in the same predicament as the victim.

In order to reduce the aforementioned problems, attempts have been made to produce a suitable rescue device. The prior art devices have general short-comings and do not adequately address the problems and difficulties stated herein.

U.S. Pat. No. 4,661,077 discloses a spherical throwing device with integrated channels to form a loop that would restrict once the rope is pulled. This particular invention has no means of keeping the loop in an open position and there is no restriction on the rope to prevent slippage of the loop size during throwing and operation. Furthermore the loop is integrally connected to the throwing ball and it would be difficult to engage the loop.

A weighted throwing bag with a securing line is described in U.S. Pat. No. 3,981,526 that allows the weighted bag to be thrown in the vicinity of a distressed person. The bag has gripping portions that can be used to cling to until help arrives or to assist in pulling the person out of the water. The bag also employs a spike tool to enable the distressed person to climb to safety out of ice. This invention relies on the distressed person to be conscious and have good motor skills to rescue him/her self.

The invention of U.S. Pat. No. 6,019,651 describes a throwable disc-shaped device connected to a rope. The disc breaks apart to produce a harness that can be grabbed by the victim or the victim can slip his arms through the harness and the harness will go around the back and under the arms. A similar device is shown in U.S. Pat. No. 5,433,637 that shows a floatation device with gripping structures and straps. One problem with these inventions is that if they are held in the hands, the victim may lose consciousness and let go of the rope. It may also be difficult to grab onto the device or straps when wearing clothing and gloves. In addition, if the person fell into an icy body of water and the harness is placed around the back of the victim, the force of the pulling will bring the person's chest against the ice.

A life ring is illustrated in U.S. Pat. No. 4,976,642 having a semi-rigid inner ring and a flexible outer ring. The distressed person is supposed to be situated within the inner ring and as the pulling rope is pulled the outer ring changes in shape so as to grip the distressed persons arms. In U.S. Pat. No. 4,701,145 another circular shaped buoy device is disclosed with a center strap and buckling devices to secure the distressed person. An inflatable buoy device is shown in U.S. Pat. No. 5,980,158. These devices generally do not have a long range throwing capacity. These devices also require some physical dexterity on the part of the distressed person. In addition, these devices tend to occupy more space and cargo room.

There are many other devices that describe various discs and rings having certain features and attributes, but all generally require the distressed person to hold onto an object or otherwise secure him/her self to the object. What is needed is a device that is compact and easily stored in convenient locations. Such a device should be capable of rapid deployment and operable by anyone. This device should be inexpensive to purchase, yet sturdy and dependable. The device should allow the rescuer to deploy the rescue device a long distance from the rescuer so that the rescuer remains safe. This device should allow the victim a fast yet secure way to be secured to the device. Furthermore, this device should hold the person in an optimal position with the head above water, even if the victim loses consciousness.

SUMMARY OF THE INVENTION

The present invention has been made in consideration of the aforementioned background, and is for a compact life-saving rescue device. The invention, that contains the floatation throwing device and the rope having a hand loop restraint, is stored securely on a rigid carrying board. This provides a convenient and inexpensive rescue device that is versatile, lightweight, and compact and can be used in ponds, rivers, streams, lakes, brooks and similar bodies of water—especially if the water is frozen or partially frozen.

An object of the invention is to provide a life safety apparatus that can be used as a first response tool. The compact device can be stowed in a car trunk or carried along when venturing out in the outdoors. It can be used to stabilize a person in distress until help arrives and may be used to assist in pulling the person to safety. The invention is held conveniently on the retaining board and quickly and easily can be extracted and delivered to the distressed person, even by a person with no training in life-saving or rescue operations.

The wrist/arm securing feature retains a firm grip on the person even if the person loses consciousness or is otherwise unable to hold onto an object.

A further object of the invention is to provide a life-saving apparatus,that is capable of being delivered a long distance from the rescuer so that the rescuer remains safe and secure. The weighted portion of the present invention allows the rope to be accurately thrown an average of 75–85 feet. In one embodiment the weighted unit is a buoyant ball.

And another object is an emergency rescue device that employs a loop positioned a short distance from the weighted portion. The loop is designed such that it secures around the wrist/arm when the rope is pulled.

Yet another object is that the present invention is comprised of relatively inexpensive components so that the unit is affordable to rescue, fire, police and emergency personnel that are on tight fiscal budgets. The device is also affordable to the general public and can put such devices in the hands of those that are first to arrive at the scene of the rescue. This is especially important when time is a critical element of survival.

And a further object of the invention is to provide a floatation device in close proximity to a distressed person to be used to help the person locate the rope and wrist loop. The buoy is fluorescent in color. The device can also employ battery operated lighting means and electronics such as global positioning systems and emergency alerting devices.

An object of the invention is a throwable rescue device, comprising a length of rope having a base end and a throwing end. In one embodiment, the rope is stranded polypropylene. There is a weighted unit connected at an end of the throwing end and a loop forming assembly engaging the rope forming an adjustable loop in the rope with a slidable end and a fixed end. The loop forming assembly is designed such that the rope retains its loop during deployment. The loop secures when the rope is pulled by the rescuer, while the distressed person has their wrist/arm through the loop. The design of the loop forming assembly always remains open until the proper angle and resistance is attained.

An object includes a throwable rescue device, wherein the loop forming assembly is comprised of a pivoting retention block, a stop sleeve, spring ring, rubber retention washer and self tapping screws. The pivoting retention block is an L shaped machined high definition polyethylene part used to ensure proper length of the loop and provides proper placement of all parts of the loop forming assembly. There are beveled surfaces in the slidable side of the block to provide ease of engagement of the stop sleeve and proper angle to the rope when the rope is pulled. The bevel to the loop side of the loop forming assembly allows the friction to the rubber washer to be reduced when the rope is pulled. The stop sleeve is stainless steel cylindrical hollow tube used to set the loop length and help provide retention support to keep loop assembly open. The spring ring is a stainless steel double loop ring to secure the stop sleeve to the rope in a fixed position on the slidable end of the loop forming assembly and prevents the stop sleeve from sliding through the pivot retention block.

The rubber retention washer is made of neoprene rubber in order to set the loop length and help provide retention with the stop sleeve to keep loop assembly open. The inner diameter of the washer contacts the rope on the slidable end of the loop forming assembly wherein an outer edge of the washer contacts the rope on an inner side of the fixed end. This configuration ensures the ring sleeve stays in proper position and the loop stays open.

Another object is a throwable rescue device, wherein the means for resisting movement is an outer edge of the washer contacting the rope at the fixed end, wherein the washer is displaced when the base end is pulled. In one embodiment, the screws are stainless steel self tapping screws used to ensure the pivoting retention block to the rope in a fixed position.

An additional object is a throwable rescue device, further comprising a storage retainer for storing the rescue device. In one embodiment the storage caddy has a hollow circular section and the rope wraps around the circular section and the ball fits within the hollow section. There can be a base portion affixed to one end of the circular section and a mating lid assembly that covers the circular section and secures to the base portion.

An object of the invention is a throwable rescue device, comprising a length of rope having a base end and a throwing end. There is a weighted unit connected at an end of the throwing end and a loop forming assembly engaging the rope and forming an adjustable loop in the rope. The loop forming assembly has a means for providing resistance on the rope to maintain a size of the adjustable loop, and a means for providing no resistance when the base end is pulled.

A further object includes the throwable rescue device, wherein the loop forming assembly comprises an 'L' shaped member having a long section and a short section with a first passage through the long section and a second passage through the section, wherein a fixed end of the adjustable loop goes through the first passage and a slidable end of the adjustable loop goes through the second passage. And, wherein the means for providing resistance comprises a stop sleeve engaging the second passage and at least one washer installed on the slidable end. Furthermore, wherein the means for providing resistance is at least one plyable washer installed on the adjustable end wherein an outer edge of the washer contacts the fixed end of the rope. An additional object further comprises a stop to limit a size of the loop, wherein the stop is a spring ring affixed to a stop sleeve that is fixedly attached to the base end proximal the loop forming assembly.

An additional object is the throwable rescue device, further comprising a storage caddy for storing the rescue device, and also wherein the rope is stranded polypropylene, and further wherein the weighted unit is a buoyant ball An object of the invention is a throwable rescue device, comprising a length of rope having a base end and a throwing end. A weighted unit is connected at an end of the throwing end and there is a loop forming assembly engaging the rope and forming an adjustable loop in the rope. The adjustable loop has a fixed end and a slidable end, and the loop forming assembly has a first passage engaging the rope on the fixed end and a second passage slidably engaging the rope on the slidable end, wherein the loop forming assembly has at least one washer installed on the slidable end.

And yet another object is the throwable rescue device, further comprising a stop affixed to the based end proximal the loop forming assembly and limiting a size of the loop when the stop contacts the loop forming assembly. The loop forming assembly may comprise an 'L' shaped member having a long section and a short section with the first passage through the long section and the second passage through the short section. In addition, the second passage can have a beveled surfaces engaging the rope. In contrast, the first orifice can employ self tapping screws affixing the rope to the loop forming assembly.

And a final object is a throwable rescue device, wherein at least one washer provides a means for resisting movement of the rope, wherein an outer edge of the washer contacts the rope at the slidable end, wherein the washer is displaced when the base end is pulled.

Still other objects and advantages of the present invention will become readily apparent to those skilled in this art from the following detailed description, wherein only a preferred embodiment of the invention is shown and described, simply by way of illustration of the best mode contemplated by me on carrying out the invention. As will be realized, the invention is capable of other and different embodiments, and its several details are capable of modifications in various obvious respects, all without departing from the invention.

BRIEF DESCRIPTION OF THE DRAWINGS

The invention is susceptible of many variations, all within the scope of the specification, figures, and claims. The preferred embodiment described here and illustrated in the figures should not be construed as in any way limiting. The present invention will be readily understood by the following detailed description in conjunction with the accompanying drawings, wherein like reference numerals designate like structural elements, and in which:

DESCRIPTION OF THE PREFERRED EMBODIMENT

The present invention refers to a rescue device that comprises a weighted object attached to a rope and having a means of securing to a person to facilitate rescue operations. A single preferred embodiment is illustrated with dimensions and particulars to demonstrate an enabled and functional description however the invention is in no way limited to this single embodiment.

Figure 1:
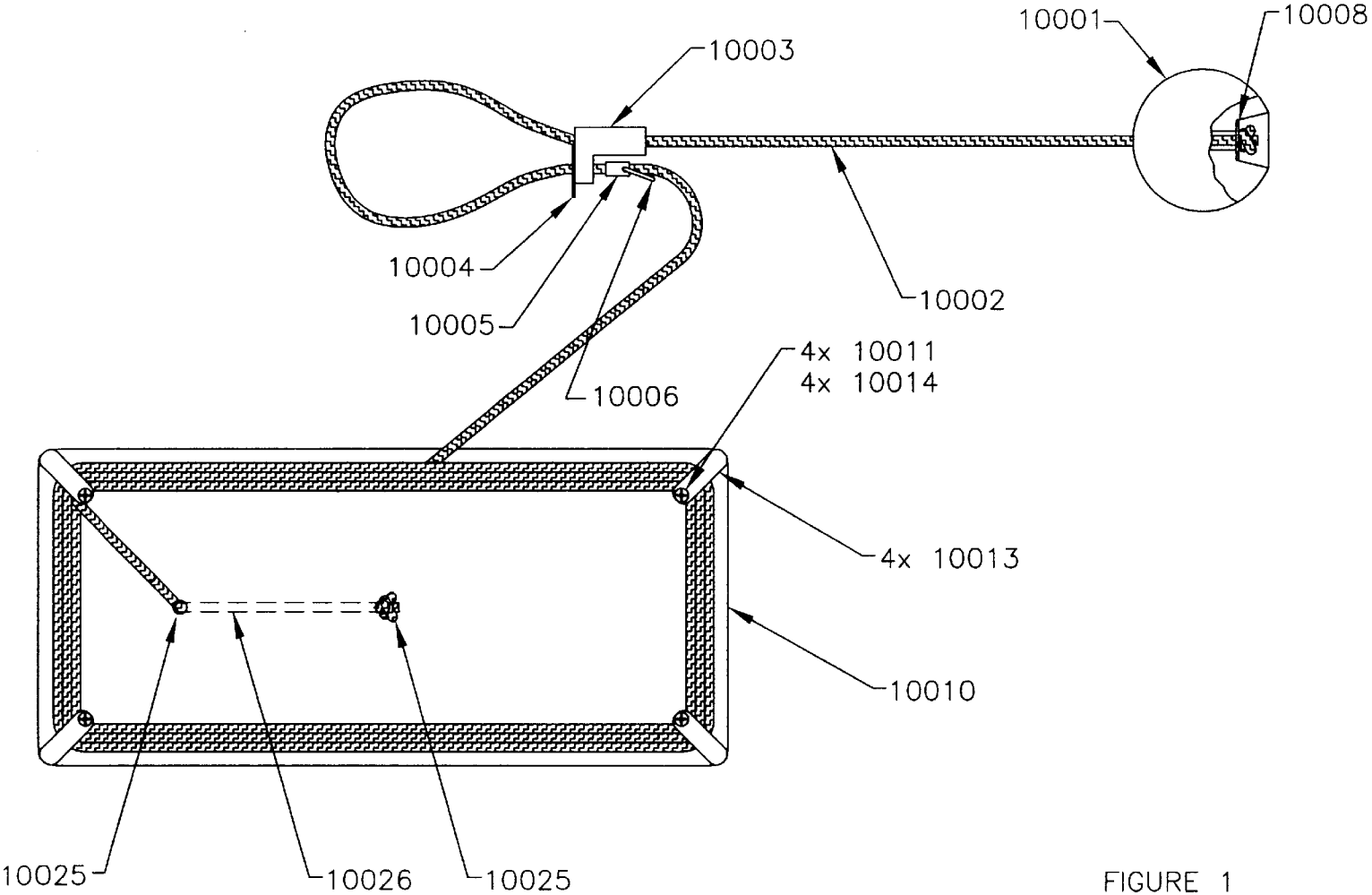
FIG. 1. illustrates the components of the invention including the rigid carrying board, weighted unit, rope and loop forming assembly and details rough dimensions and orientations from a top view
Figure 5:
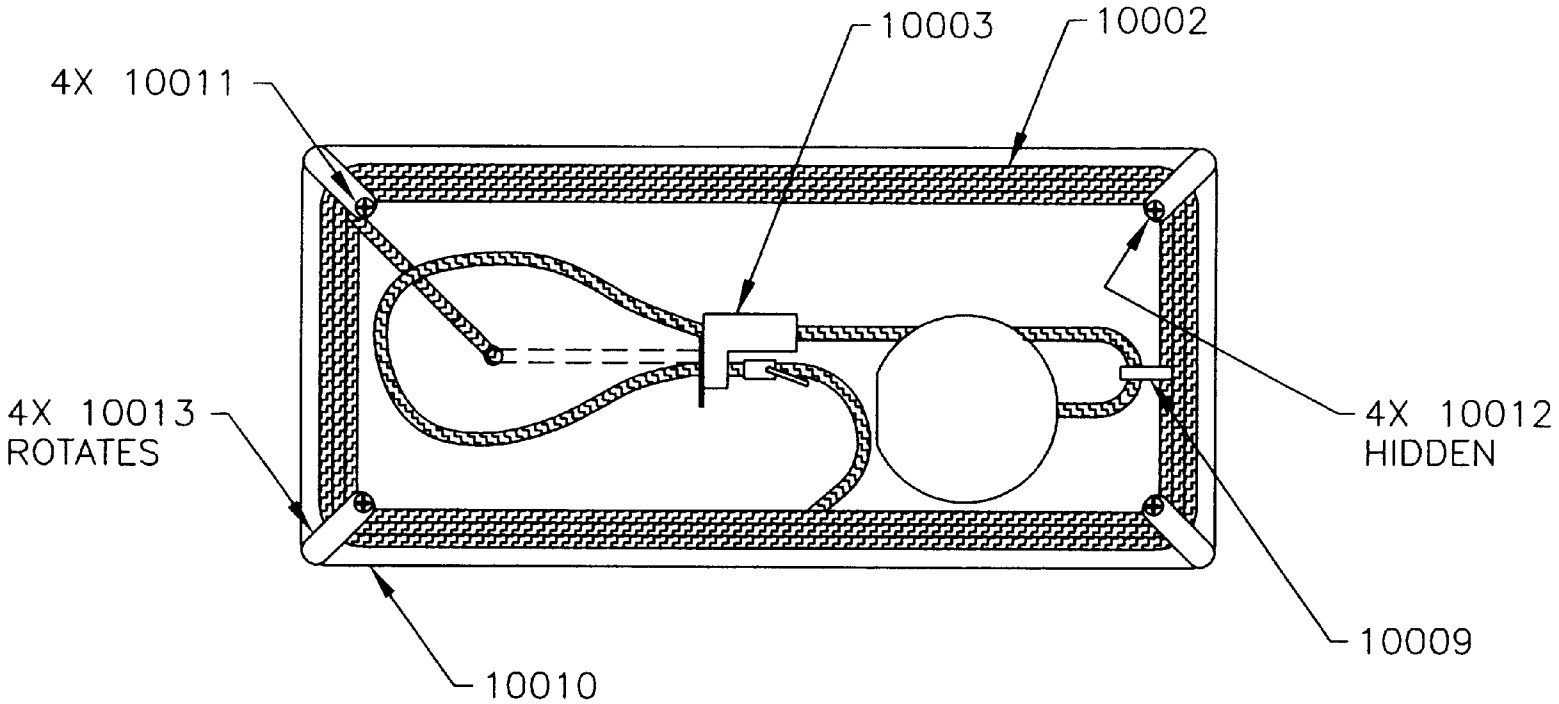
FIG. 5 shows the fully assembled unit stored on rigid carrying board FIG. 6 demonstrates one method of throwing wherein an underhand lob is used

Referring to FIG. 1 and FIG. 5, one embodiment of a layout of the invention is illustrated. In this embodiment, the invention is depicted in kit form that is easily mounted and stored on rigid carrying board 10010. The rigid carrying board 10010 should be durable and lightweight, and one such material for the rigid carrying board 10010 is plexi-glass. The rigid carrying board 10010 is approximately 18½ inches long and 8½ inches wide with holes positioned about the perimeter of the board 10010 to secure the rope 10002 to the rigid carrying board 10010 and to mount plexi-glass rope retainers 10013. The plexi-glass rope retainers 10013 are mounted at each corner approximately 1¼ inches from an end and a side of the rigid carrying board 10010 through cylindrical spacers 10012 using pan screw 10011 and nylon locking nut 10014. The cylindrical spacers 10012 should be of a rigid durable material as nylon with dimensions approximately 1½ inches long by ⅜ inch in diameter.

The plexi-glass rope retainers 10013 are able to rotate such that plexi-glass rope retainers 10013 can be positioned outward from the center of the rigid carrying board 10010 and will securely hold the coiled rope 10002 and weighted end of the device or two or more of the plexi-glass rope retainers 10013 can be positioned in towards the center of the rigid carrying board 10010 where one could remove the rope 10002 and weighted end of the device for deployment.

FIG. 5 depicts the plexi-glass rope retainers 10013 positioned outward such the fully assembled unit is securely stored. The retainers 10013 are rotatable about the spacer 10012 so that they can be swung to be positioned pointing inward to allow the rope 10002 to slip off efficiently from the retainer 10013 for deployment mode. The rope 10002 is looped through one or more holes 10025 in the rigid carrying board 10010 such that the rope 10002 is secured to the rigid carrying board 10010 by a knot on the end of the rope 10002. In one embodiment a loop 10026 is formed on the side opposing the retainers 10013 and makes a handle to be able to easily carry the device or position for deployment. A Velcro® loop 10009 or other hook and loop type fastener is further used to secure the weighted end of the device when stored. The combination of the rigid carrying board 10010, plexi-glass rope retainers 10013, cylindrical spacers 10012, pan head screws 10011 and nylon locking nuts 10014 allows a means for safe storage, transportation and fast deployment of the device.

It should be apparent that the storage and packaging of the invention may occur in many forms that have been contemplated and within the scope of the invention. For example, the stowage can be accomplished upon a circular assembly having a hollow center for housing the weighted ball. Such an assembly can have raised edges or a sloping profile similar to a wheel rim that would maintain the rope 10002 centered about the assembly. In the rigid board scheme, a second board can be used in place of the retainers and one side of the boards can be displaced to free the rope for deployment. The apparatus can be stowed in a bag for easy transport and there are numerous other rope stowing methods already described in the prior art.

The rope 10002 in this embodiment is approximately 100 feet in length by ¼" in diameter. This dimension tends to provide adequate distance for a rescue, sufficient strength for hauling, and light enough to optimize throwing distance. In the preferred embodiment the rope 10002 is a nylon polypropylene that also has the advantage of being a floatation material. Allowing the rope 10002 to float on the surface of water makes it easier to be located by a distressed person such as someone that is fully dressed and in cold water.

Figure 2:
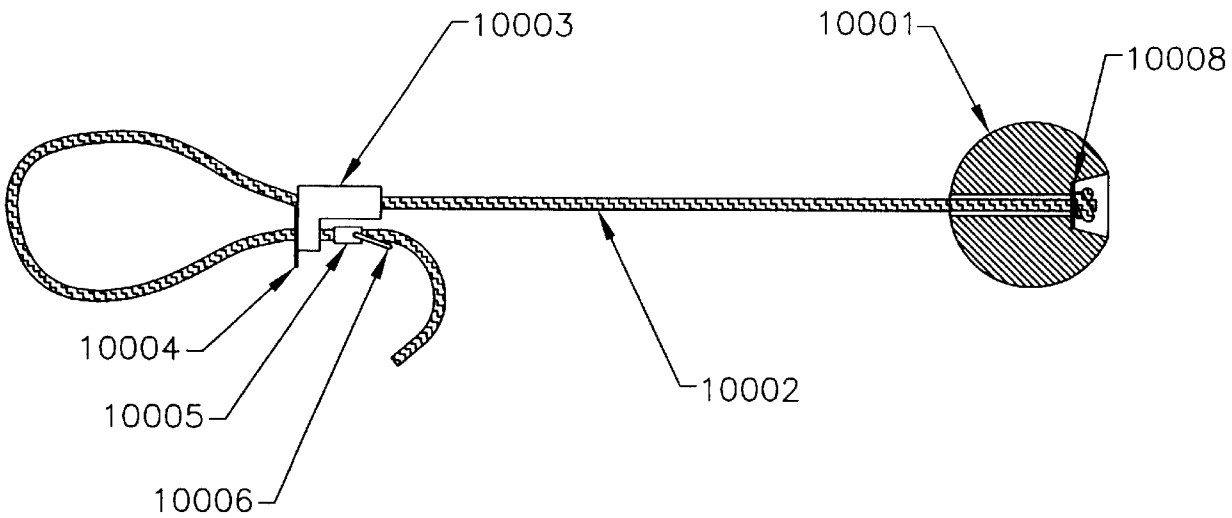
FIG. 2 shows the weighted end portion in more detail

FIG. 2 illustrates the orientation of the fluorescent ball 10001 with respect to the loop forming assembly 10003. It also illustrates the wrist adjustable loop that is used to grip the person in distress. The loop is adjustable in size and tightens when the weighted end of the rope is pulled.

Figure 3:
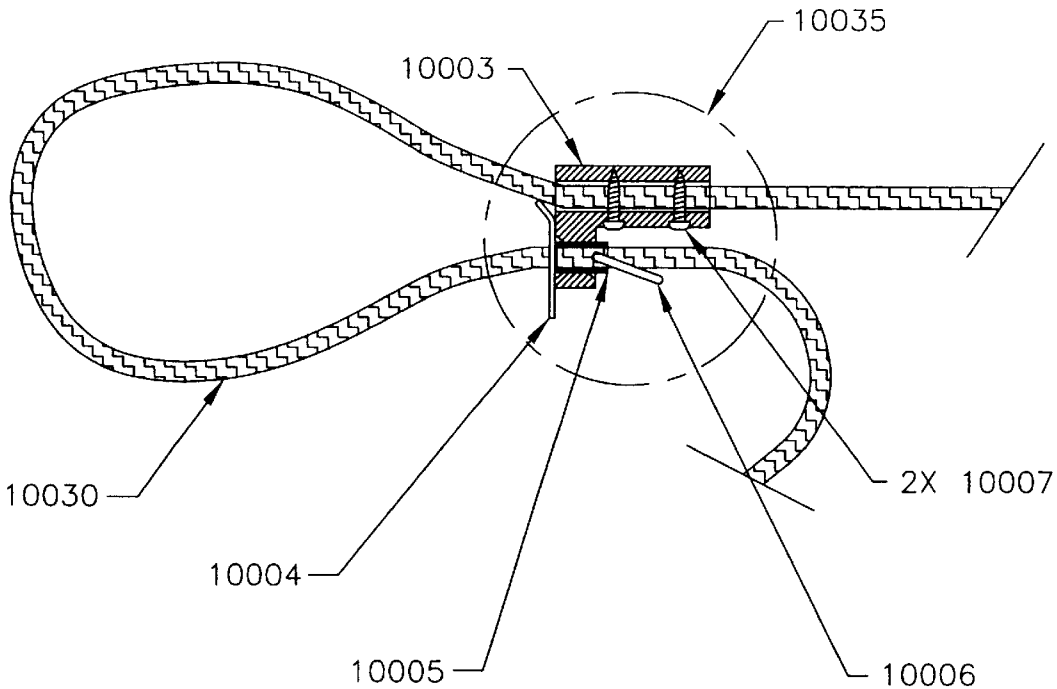
FIG. 3 is a close-up of the loop forming assembly, showing the interaction between the rope, the pivoting retention block, the stop sleeve, spring ring, screws and the washer FIG. 4 provides further details of the pivoting retention block forming assembly and highlights the beveled or countersunk holes

FIG. 3 is a detailed view of the loop forming assembly that details the individual elements and shows the interaction of the rope 10002, the pivoting retention block 10003, the stop sleeve 10005, spring ring 10006, washer 10004, and screws 10007. The pivoting retention block 10003 is a manufactured piece that ensures the rope reacts properly during flight and when the carrying board end of the rope is pulled. In this embodiment it is made of High Density Polyethelene (HDPE).

The rope has a loop forming assembly 10035 as depicted in FIG. 2 and FIG. 3 comprised of a pivoting retention block 10003, a stop sleeve 10005, spring ring 10006, rubber retention washer 10004 and self tapping screws 10007. The loop forming assembly 10035 forms an adjustable loop 10030 in the rope 10002. In the illustrated example, the adjustable loop 10030 is approximately 7" in diameter and held together by the loop forming assembly 10035. The characteristics and dimensions of the rope 10002 affect the size of the adjustable loop 10030 to some extent, but the function of the adjustable loop 10030 is to remain an easy target for a victim to insert their hands or arm.

The rope 10002 is terminated in a throwing unit 10001 and affixed within the throwing unit 10001 by many means such as a knot, fastener and similar known techniques. In a preferred embodiment, a fluorescent rubber ball 10001 approximately 4 inches in diameter and weighing about 12 ounces is used. In one embodiment, the rope 10002 is slipped through a center of the ball 10001 and a knot or other fastener is used to fasten the ball 10001 to the rope 10002. The rope 10002 is not intended to be slidable within the ball 10001 but rather to remain a fixed element. The ball 10001 is made to be buoyant so that it floats.

Many throwing units are also within the scope of the invention, including torpedo buoys, discs and rings. However, the intent of the throwing unit is to provide for optimal throwing distance and accuracy. The size and weight of the throwing unit 10001 are important characteristics in placing the adjustable loop 10030 in close proximity to the victim, even in less than desirable weather conditions. The throwing unit 10001 should also be of a material that has some impact absorbing qualities in the event that the object 10001 strikes the victim. Various electronics such as global positioning system (GPS) location tracking electronics can be incorporated into the throwing unit 10001, if required.

The prior art discusses many different types of rescue throwing devices, including elliptical or disc-shaped devices. The present invention is equally applicable to usage of the disc shaped units, as these discs generally have less air resistance and ten d to provide a longer distance. However, throwing a discus requires more practice for accuracy whereas the present invention requires minimal training for distance and accuracy.

TABLE A

| | Weight | | | |
|---|---|---|---|---|
| Throw | 15.1 oz | 13.4 oz | 12.8 oz | 12.0 oz |
| 1 | 79.4 | 71.4 | 76.2 | 79.6 |
| 2 | 81.6 | 73.8 | 79.3 | 85.2 |
| 3 | 84.3 | 72.1 | 80.1 | 82.4 |
| 4 | 86.5 | 75.4 | 79.2 | 80.7 |
| 5 | 83 | 72.2 | 80 | 78.8 |
| 6 | 88.7 | 73.5 | 71 | 83.5 |
| 7 | 87.9 | 76.6 | 84.1 | 86.5 |
| 8 | 99.5 | 72.9 | 81.2 | 85.4 |
| 9 | 92.5 | 70 | 79.4 | 81.3 |
| 10 | 88.7 | 76.1 | 82 | 84 |
| AVG Distance | 87.2 | 73.9 | 79.25 | 82.74 |

As shown in Table A, various weights were thrown ten times and the distance measured for each throw to establish an average distance. As depicted, all the weights tested produced distances in excess of 70 feet.

Figure 4:
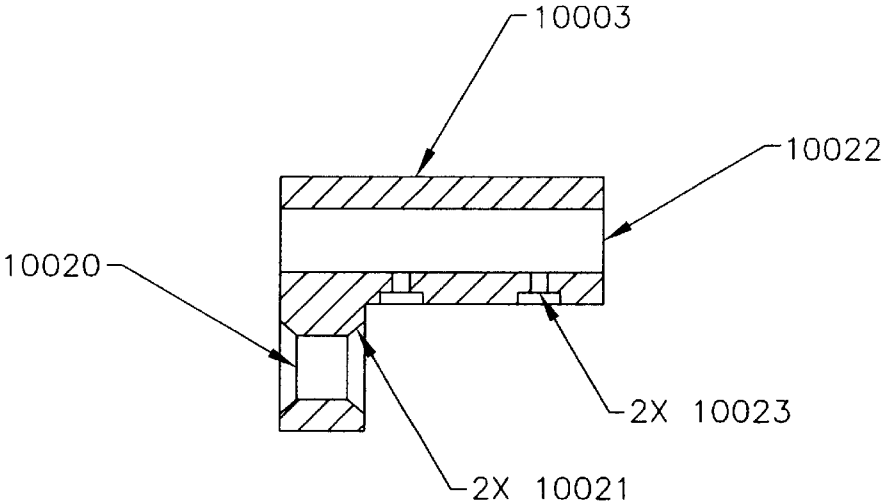

As depicted om FIG. 4, the pivoting retention block 10003 is shaped like an 'L' with approximate dimensions of 2 inches long, 1½ inches wide and ¾ inch thick. There is a first hole 10020 approximately ⅜ inches in diameter drilled through the pivoting retention block 10003 with counter sunk chamfers ⅝ inches in diameter by 90 degrees on each side 10021. There is a second hole 10022 that is approximately ⅜ inches in diameter that is drilled through the pivoting retention block 10003 end to end of the long dimension of the L of the block. The holes 10020, 10022 are positioned to separate the rope 10002 and to form the adjustable loop 10030.

The rope 10002 from the weighted end goes through the hole 10022 that is drilled end to end of the long dimension of the pivoting retention block 10003 and is attached to the pivoting retention block 10003 with two stainless steel self tapping screws 10007 at approximately 11 inches from the ball 10001. The two screws 10007 in the pivoting retention block 10003 intersect the rope 10002 at approximately 90 degrees and the screws 10007 go through the rope 10002. The screw holes 10023 are drilled approximately ¾ inch apart through the flat side on the longer side of the L of the pivoting retention block 10003 into the hole 10022 that is that is drilled end to end of the long dimension of the pivoting retention block 10003.

The adjustable loop 10030 is formed from the junction of the rope 10002 as it is attached to the pivoting retention block 10003 via the two screws 10007 and as it goes through the hole 10020 with counter sunk chamfers 10021 in the pivoting retention block 10003 and to the spring ring 10006 in the stop sleeve 10005. The spring ring 10006 in this embodiment is approximately 9/10 inches in outer diameter and ¾ inches inside diameter and made from stainless steel. The stop sleeve 10005 in this embodiment is a cylindrical hollow tube approximately 9/10 inches by ⅜ inch. The stop sleeve 10005 is secured to the rope 10002 via a spring ring 10006 that goes through the stop sleeve 10005 and through the rope 10002. The purpose of the stop sleeve 10005 is to set the loop length and help provide support to keep the loop assembly open.

The spring ring 10006 attaches the stop sleeve 10005 to the rope 10002 in a fixed position and prevents the stop sleeve 10005 from sliding through the pivoting retention block 10003 to the ball end of the rope. The attachment of the stop sleeve 10005 on the rope 10002 at approximately 40 inches from the ball 10001 and the attachment of the rope 10002 to the pivoting retention block 10003 at approximately 11 inches from the ball 10001 sets the proper dimensions for loop diameter 10030 and ensures throwing ease. Thus, the length of the loop portion of the rope is approximately 22 inches.

The retention washer 10004 is a closed cell neoprene washer approximately 1½" in diameter and 1/16" thick. The retention washer 10004 is designed to prevent slippage of the adjustable loop prior to the carrying board 10010 end of the rope 10002 being pulled. The retention washer 10004 also ensures that the stop sleeve 10005 stays located inside the chamfered hole in the pivoting retention block 10003 while the rope is being thrown.

The retention washer 10004 contacts the pivoting retention block 10003 where the rope 10002 goes through the chamfered hole 10020 in the pivoting retention block 10003. As depicted, the outer edge of the washer 10004 is in physical contact with the weighted end of the rope 10002 while the other end of the rope 10002 has the stop sleeve 10005 and goes through the center of the washer 10004. The dimension of the inner diameter of the hole in retention washer 10004 is 1/16" smaller than the polypropylene rope 10002 to provide resistance to movement of the rope 10002.

A single washer 10004 can be used of appropriate thickness and elasticity, or multiple washers 10004 can be utilized according to the desired qualities. The wider the surface area of the washer 10004 edge contacting the rope 10002, the greater the resistance upon the rope 10002 while closing the adjustable loop 10030. While a separate washer 10004 is depicted, incorporating the functionality of the washer 10004 as an integrated element of the pivoting retention block 10003 is an obvious variation of the present invention.

Figure 6:
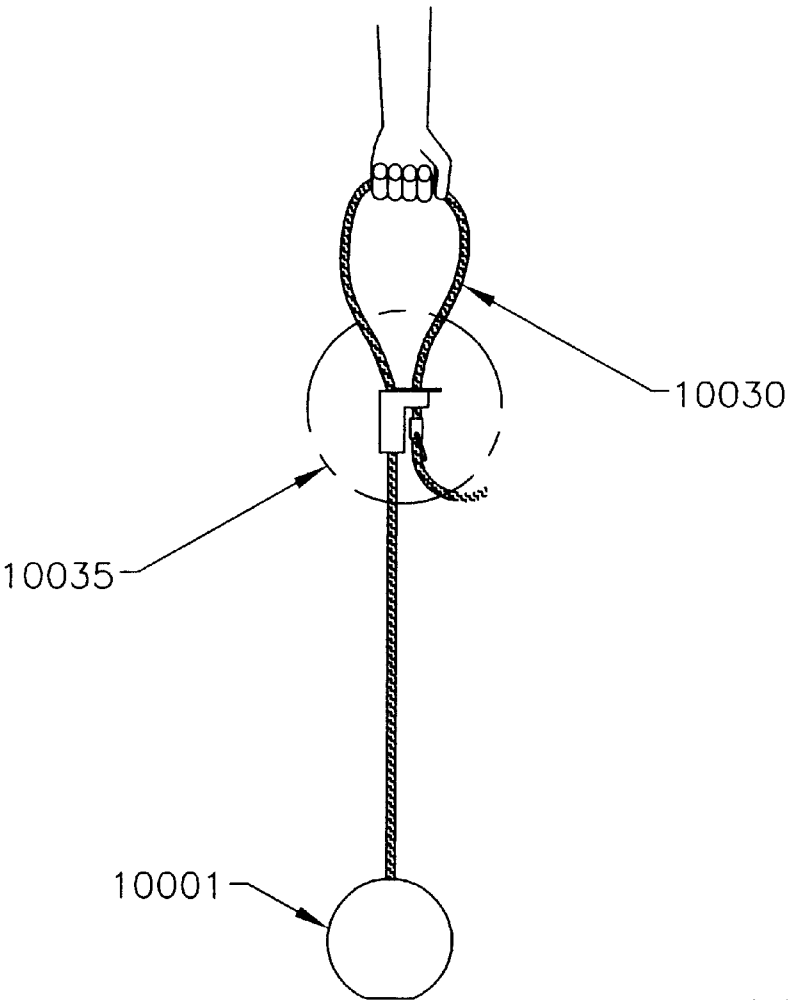

FIG. 6 demonstrates a preferred hand location for throwing the rescue device. The loop 10030 acts as a handle so the rescue device can be thrown using an underhand bowling or softball pitching motion. The combination of the position of hand location in the loop 10030 together with the pendulum motion of the thrower's arm allows distances of up to 75' to be achieved with relative ease as shown in Table A.

Figure 7:
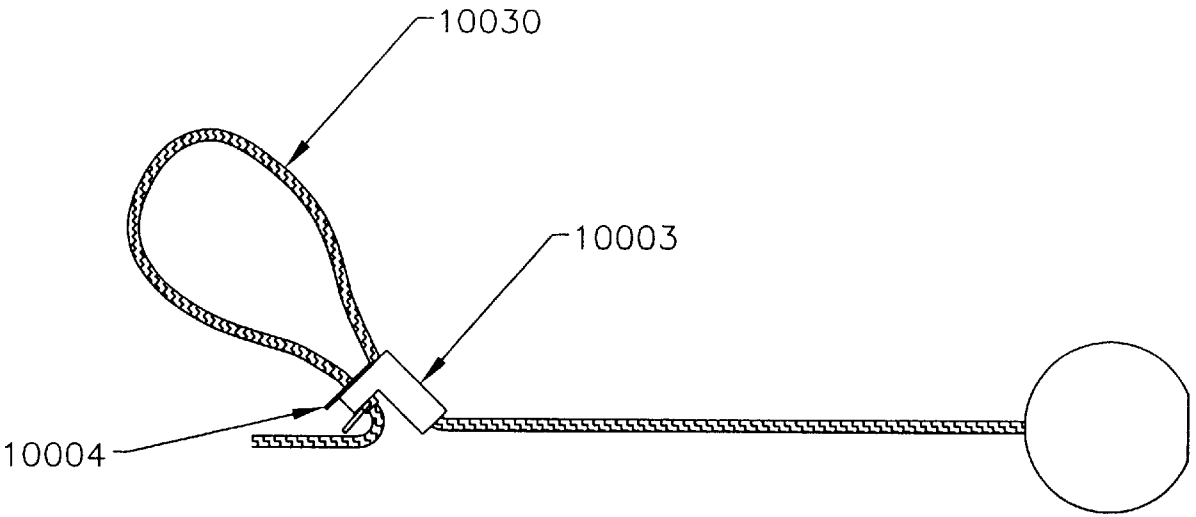
FIG. 7 shows the angular position of the rope to the loop forming assembly when unit is in flight

FIG. 7 demonstrates the position and angle of the loop forming assembly with respect to the rope 10002 when the unit is in flight or when the carrying board 10010 end of the rope 10002 is pulled by the rescuer. It is the combination of the angular position of the pivoting retention block 10003, the contact of the stop sleeve 10005 with the pivoting retention block 10003, and the friction of the rubber retention washer 10004 to the rope 10002 that prevents the adjustable loop 10030 from closing. The washer 1004 adopts a concave form as it holds the rope in place. The stop sleeve is within the retention block and due to the angle of the rope to the user, has enough resistance to maintain the loop 10030 in place.

The tension provided by the propulsion of the ball 10001 during deployment, or the tension provided by the weight of the ball 10001 when the carrying board 10010 end of the rope 10002 is pulled by the rescuer, keeps the pivoting retention block 10003 angled such that the stop sleeve 10005 provides resistance to movement of the rope 10002. The rubber washer 10004 ensures the stop sleeve 10005 stays positioned within the chamfered hole 10020 in the pivoting retention block 10003 and also provides resistance to movement of the rope 10002.

Figure 8:
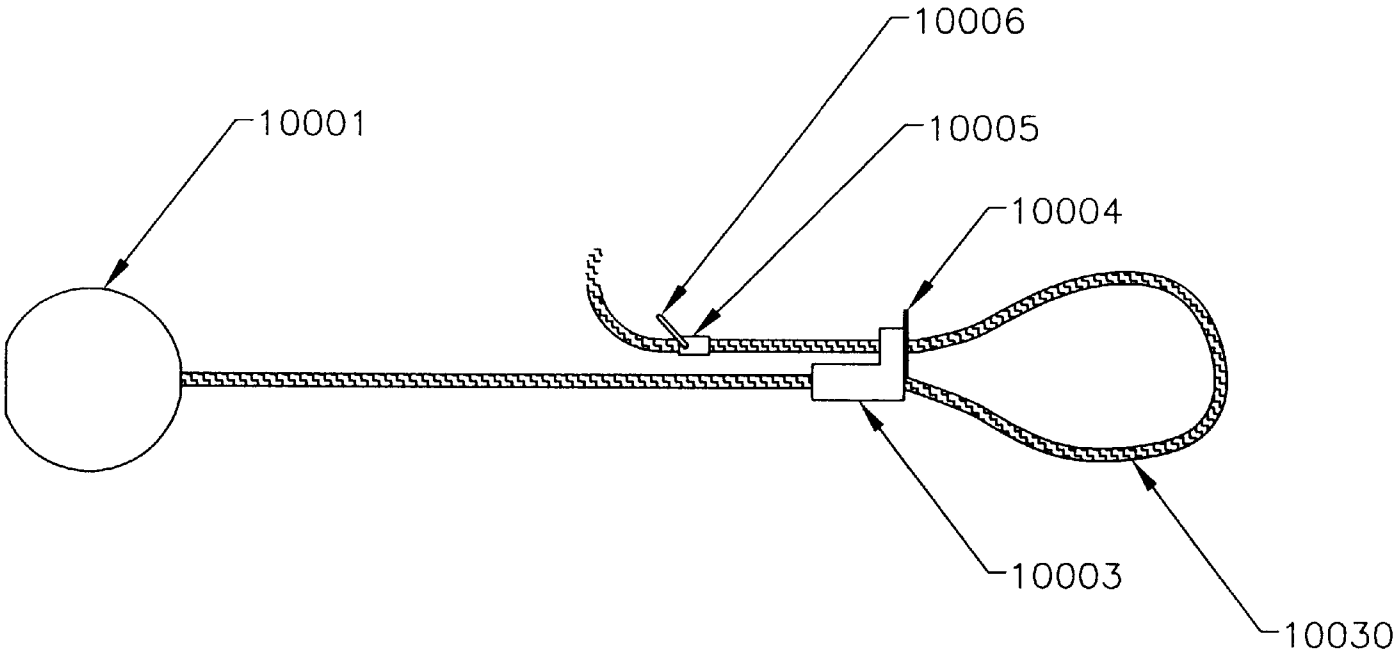
FIG. 8 illustrates the angular position of the rope to the loop forming assembly when unit is in wrist/arm is in the loop and unit is being pulled.

FIG. 8 depicts the collapse of the loop 10030 upon the victim's or arm when the victim inserts their arm into the loop 10030. When the victim inserts their wrist or arm into the adjustable loop 10030, it provides movement to the loop portion of rope 10002. This movement causes rotation or pivoting of the pivoting retention block 10003 such that the stop sleeve 10005 then is able to slide out the pivoting retention block 10003. Once the stop sleeve 10005 has slid out of the pivoting retention block 10003 there is less friction to keep the loop open. The chamfered hole 10020 in the pivoting retention block 10003 reduces the friction of the rope 10002 on the pivoting retention block 10003. The retention washer 10004 is flexed inward to the bevel in the chamfered hole 10020 and this also reduces the friction of the retention washer 10004 on the rope 10002. This combination of events allows the adjustable loop to close without resistance and is essentially self-closing.

It should be noted that intention and motivation of the present invention is to be a low cost and simplistic unit and further enhancements are possible. In operation, the device is typically carried in a trunk of a car such as a rescue vehicle or police cruiser and is carried as close as possible to the site of the emergency and near the distressed person. The unit is typically stored in a ready-to-use state where the rope 10002 is coiled on the rigid carrying board 10010.

The user can rotate two or more of the rope retainers 10013, grasp the coiled rope 10002 and weighted end 20002, then drop the rigid carrying board 10010 to the ground. The user can then drop the coil of rope 10002 to the ground approximately 5–6 feet away from the rigid carrying board 10010. Then user can hold the rescue device as shown in FIG. 6 by holding the loop portion 10030 with the ball 10001 at an opposing end of the user's hand. The rescuer can then lob the ball 10001 to the person in distress and preferably within very close proximity. The loop forming assembly 10035 holds the loop open during flight to the person in distress.

Depending upon the weather conditions and experience of the rescuer, it may take more than a single attempt to place the rescue device in the proper location for the distressed person. Verbal commands can be issued to the distressed person if possible, but in most cases the person in distress will try to instinctively grab whatever is in reach. Once the person in distress inserts one or both wrists into the loop or otherwise grabs the loop rope, the rescuer pulls the rope. As the rope is pulled the loop forming assembly 10035 rotates and the loop 10030 collapses without resistance.

No warranty is expressed or implied as to the actual degree of safety, security or support of any particular specimen of the invention in whole or in part, due to differences in actual production designs, materials and use of the products of the invention.

The foregoing description of the preferred embodiment of the invention has been presented for the purpose of illustration and description. It is not intended to be exhaustive or to limit the invention to the precise form disclosed. Many modifications and variations are possible in light of the above writings. It is intended that the scope of the invention be limited not by this detailed description, but rather by the claims appended hereto.

The invention is susceptible of many variations, all within the scope of the specification, figures, and claims. The preferred embodiment described here and illustrated in the FIGS. should not be construed as in any way limiting.

What is claimed is:

1. A throwable rescue device, comprising:

a length of rope having a base end and a throwing end;

a weighted unit connected at an end of said throwing end;

a loop forming assembly engaging said rope and forming an adjustable loop in said rope, said loop forming assembly having a means for providing resistance on said rope to maintain a size of said adjustable loop, and a means for providing no resistance when said base end is pulled.

2. The throwable rescue device according to claim 1, wherein said loop forming assembly comprises an 'L' shaped member having a long section and a short section with a first passage through said long section and a second passage through said short section, wherein a fixed end of said adjustable loop goes through said first passage and a slidable end of said adjustable loop goes through said second passage.

3. The throwable rescue device according to claim 2, wherein said means for providing resistance comprises a stop sleeve engaging said second passage and at least one washer installed on said slidable end.

4. The throwable rescue device according to claim 1, further comprising a storage caddy for storing said rescue device.

5. The throwable rescue device according to claim 1, wherein said means for providing resistance is at least one plyable washer installed on said adjustable end wherein an outer edge of said washer contacts said fixed end of said rope.

6. The throwable rescue device according to claim 1, further comprising a stop to limit a size of said loop.

7. The throwable rescue device according to claim 6, wherein said stop is a spring ring affixed to a stop sleeve that is fixedly attached to said base end proximal said loop forming assembly.

8. The throwable rescue device according to claim 1, wherein said rope is stranded polypropylene.

9. The throwable rescue device according to claim 1, wherein said weighted unit is a buoyant ball.

10. A throwable rescue device, comprising:

a length of rope having a base end and a throwing end;

a weighted unit connected at an end of said throwing end;

a loop forming assembly engaging said rope and forming an adjustable loop in said rope, said adjustable loop having a fixed end and a slidable end, said loop forming assembly having a first passage engaging said rope on said fixed end and a second passage slidably engaging said rope on said slidable end, wherein said loop forming assembly has at least one washer installed on said slidable end .

11. The throwable rescue device according to claim 10, further comprising a stop affixed to said based end proximal said loop forming assembly and limiting a size of said loop when said stop contacts said loop forming assembly.

12. The throwable rescue device according to claim 10, wherein said loop forming assembly comprises an 'L' shaped member having a long section and a short section with said first passage through said long section and said second passage through said short section.

13. The throwable rescue device according to claim 10, wherein said second passage has beveled surfaces engaging said rope.

14. A throwable rescue device according to claim 10, wherein said first passage has self tapping screws affixing said rope to said loop forming assembly.

15. A throwable rescue device according to claim 10, wherein said at least one washer provides a means for resisting movement of said rope, wherein an outer edge of said washer contacts said rope at said slidable end, wherein said washer is displaced when said base end is pulled.

16. A throwable rescue device according to claim 10, further comprising a sleeve affixed on said rope and engaging said second passage of said loop forming assembly resisting movement of said rope.

* * * * *